US011879372B2

(12) United States Patent
Hammer et al.

(10) Patent No.: US 11,879,372 B2
(45) Date of Patent: Jan. 23, 2024

(54) CONNECTION UNIT

(71) Applicant: Purem GmbH, Neunkirchen (DE)

(72) Inventors: Jochen Hammer, Stuttgart (DE); Holger Brenner, Stuttgart (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 17/893,927

(22) Filed: Aug. 23, 2022

(65) Prior Publication Data

US 2023/0067074 A1 Mar. 2, 2023

(30) Foreign Application Priority Data

Aug. 24, 2021 (DE) ..... 10 2021 121 835.7

(51) Int. Cl.
*F01N 3/00* (2006.01)
*F01N 3/20* (2006.01)

(52) U.S. Cl.
CPC ..... *F01N 3/2013* (2013.01); *F01N 2240/16* (2013.01); *F01N 2260/20* (2013.01); *F01N 2450/16* (2013.01)

(58) Field of Classification Search
CPC ..... F01N 3/2013; F01N 2240/16; F01N 2260/20; F01N 2450/16; F01N 13/1827; F01N 3/027
See application file for complete search history.

(56) References Cited

U.S. PATENT DOCUMENTS 4,608,698 A 8/1986 Moller et al.
5,227,587 A * 7/1993 Paterek ..... H01B 17/305 174/152 R
5,626,785 A * 5/1997 Rajnik ..... H05B 3/08 219/205
5,670,746 A * 9/1997 Hashimoto ..... H01R 13/73 422/174
5,887,427 A * 3/1999 Maus ..... F01N 3/2026 422/174
5,935,473 A 8/1999 Hashimoto et al.
(Continued)

FOREIGN PATENT DOCUMENTS

DE 35 31 827 A1 3/1986
DE 10 2019 121 345 A1 2/2021
(Continued)

*Primary Examiner* — Matthew T Largi
(74) *Attorney, Agent, or Firm* — Walter Ottesen, P.A.

(57) ABSTRACT

A connection unit for connecting an electrical supply line to an exhaust gas heater of an exhaust system of an internal combustion engine includes an electrically conductive connection element. The connection element has a heater connection region in a first end region and a supply line connection region in a second end region. A carrier has a receiving opening, wherein the connection element is arranged and has a support region. A first insulating element is arranged in the opening and surrounds the support region. A second insulating element is arranged on a first end face of the carrier. The connection element is supported with respect to the first end face via the second insulating element. A third insulating element is arranged on a second end face of the carrier. The connection element is supported with respect to this second end face via the third insulating element.

14 Claims, 4 Drawing Sheets

(56) References Cited

U.S. PATENT DOCUMENTS

| | | | | |
|---|---|---|---|---|
| 6,025,578 | A * | 2/2000 | Bruck | F01N 3/2026 422/177 |
| 6,031,213 | A * | 2/2000 | Hashimoto | F01N 3/2026 422/174 |
| 6,109,946 | A * | 8/2000 | Hotz | H01R 4/56 422/174 |
| 6,176,081 | B1 * | 1/2001 | Shimasaki | F01N 3/2026 422/174 |
| 9,225,107 | B2 * | 12/2015 | Hirth | H05B 3/42 |
| 10,941,688 | B2 | 3/2021 | Hirth et al. | |
| 2011/0000194 | A1 * | 1/2011 | Gonze | F01N 3/103 60/297 |
| 2014/0319117 | A1 * | 10/2014 | Miyamoto | F01N 3/2013 219/205 |
| 2015/0011115 | A1 | 1/2015 | Hirth et al. | |
| 2022/0065147 | A1 | 3/2022 | Sugaya et al. | |
| 2022/0136422 | A1 * | 5/2022 | Brück | F01N 3/2026 60/300 |

FOREIGN PATENT DOCUMENTS

| | | | |
|---|---|---|---|
| EP | 0 739 152 | A1 | 10/1996 |
| EP | 0 942 158 | A2 | 9/1999 |
| JP | 2020-143662 | A | 9/2020 |
| WO | 97/47057 | A1 | 12/1997 |

* cited by examiner

CONNECTION UNIT

CROSS REFERENCE TO RELATED APPLICATION

This application claims priority of German patent application no. 10 2021 121 835.7, filed Aug. 24, 2021, the entire content of which is incorporated herein by reference.

TECHNICAL FIELD

The present disclosure relates to a connection unit which can be used to electrically conductively connect an exhaust gas heater provided in an exhaust system of an internal combustion engine to an electrical supply line leading to a voltage source.

BACKGROUND

Such a connection unit is known from U.S. Pat. No. 10,941,688 B2. An electrically conductive connection element of this known connection unit, the connection element being elongated in the direction of a longitudinal axis, is surrounded by a sleeve-like carrier made of metal material. For electrical insulation, a sleeve-like insulating element is arranged between the sleeve-like carrier and the connection element, the axial extension of the insulating element being greater than the axial extension of the sleeve-like carrier, so that the insulating element, surrounding the connection element over the entire axial length of the insulating element, projects axially beyond the sleeve-like carrier. This axially uninterrupted covering of the connection element beyond the axial extension of the sleeve-like carrier is intended to prevent the occurrence of leakage currents, while at the same time providing a stable connection, suitable for absorbing torques, between the connection element and the sleeve-like carrier.

SUMMARY

It is an object of the present disclosure to provide a connection unit for connecting an electrical supply line to an exhaust gas heater of an exhaust system of an internal combustion engine, with which connection unit, with a simple constructive configuration, an electrically insulated feedthrough resistant to the thermal load that occurs in an exhaust system and that affects the various components thereof can be provided.

According to the disclosure, this object can be achieved by a connection unit for connecting an electrical supply line to an exhaust gas heater of an exhaust system of an internal combustion engine, the connection unit comprising:

- an electrically conductive connection element elongated in the direction of a longitudinal axis, wherein the connection element has an exhaust gas heater connection region in a first axial end region and has a supply line connection region in a second axial end region,
- a connection element carrier with a connection element receiving opening, wherein the connection element passes through the connection element receiving opening with a support region lying between the first axial end region and the second axial end region,
- a first insulating element arranged in the connection element receiving opening and surrounding the support region,
- a second insulating element arranged on a first end face of the connection element carrier facing the first axial end region of the connection element, wherein the connection element is supported axially with respect to the first end face of the connection element carrier via the second insulating element,
- a third insulating element arranged on a second end face of the connection element carrier facing the second axial end region of the connection element, wherein the connection element is supported axially with respect to the second end face of the connection element carrier via the third insulating element.

In the connection unit constructed in accordance with the disclosure, a multi-piece or sandwich-like structure of the electrical insulation is provided between the connection element and the connection element carrier, in which the firm bond between the connection element and the connection element carrier is established substantially by axial bracing between the two insulating elements supported with respect to the end faces of the connection element carrier. This results in a bond that allows for different thermal expansions, which, for example, does not require a materially bonded connection of individual components of the connection unit to each other.

In order to allow for thermally induced relative movements, it is proposed that the first insulating element, the second insulating element and the third insulating element are configured as separate components.

To achieve efficient electrical insulation between the connection element and the connection element carrier, the first insulating element can be configured as an insulating sleeve, and/or the second insulating element can be configured as an insulating washer, and/or the third insulating element can be configured as an insulating washer. In this context, it should be noted that in the case of such ring-like components of the connection unit through which the connection element passes, a sleeve-like structure can be assumed if a radial wall thickness of the component under consideration is smaller than the axial extension length of this component, while a washer-like structure can be assumed if the radial wall thickness of the component under consideration is in the range of the radial wall thickness or smaller than this.

In order to avoid axial constraint stresses of the first insulating element, it is proposed that an axial extension length of the first insulating element is smaller than an axial distance of the second insulating element to the third insulating element, and/or that an axial gap is formed between the first insulating element and at least one insulating element of the second insulating element and the third insulating element, and/or that an axial extension length of the first insulating element is smaller than an axial extension length of the connection element receiving opening.

For axial support of the connection element with respect to the connection element carrier at its axial end faces, the connection element can be axially supported on the second insulating element via a first abutment arrangement and axially supported on the third insulating element via a second abutment arrangement.

In order to enable assembly of the connection unit according to the disclosure with a simple structural configuration, it is proposed that one abutment arrangement of the first abutment arrangement and second abutment arrangement, preferably the first abutment arrangement, includes an abutment protrusion which is fixedly provided on the connection element and projects radially outward, and/or that one abutment arrangement of first abutment arrangement and second abutment arrangement, preferably the second abutment arrangement, includes an abutment element which is coupled to the connection element in an axially displaceable manner with respect thereto.

To generate a defined axial clamping force here, the abutment element can be coupled to the connection element by threaded engagement.

To allow for different thermal expansions, at least one abutment arrangement of the first abutment arrangement and second abutment arrangement, preferably the second abutment arrangement, can include at least one axially elastic support element in the support path between the connection element and the connection element carrier.

The at least one axially elastic support element can, for example, be configured as a disc spring or corrugated spring.

In order to ensure a defined positioning of the connection unit on an outer wall of an exhaust gas routing component to be connected to the connection unit, it is proposed that a centering protrusion surrounding the connection element receiving opening is provided on the first axial end face of the connection element carrier. Such a centering protrusion can be engaged in an opening in such a wall, through which opening the connection unit passes, thereby positioning the connection unit in a centering manner.

The second insulating element can be axially supported on the centering protrusion, since this forms the region of the connection element carrier projecting the furthest axially.

In order to be able to establish a connection to a supply line leading to a voltage source, the connection unit may include a supply line connection element coupled or couplable to the connection element in its supply line connection region.

For predetermining a defined relative positioning between such a supply line and the connection unit, the supply line connection element can be held in a predetermined position about the longitudinal axis by a form-fit positioning formation with respect to the supply line connection region.

In order to also achieve a defined positioning for the connection element with respect to the connection element carrier, it is proposed that the connection element is held in a rotationally fixed manner with respect to the connection element carrier via a friction fit and/or a form fit. It is particularly advantageous here if such a friction fit and/or form fit is only or substantially only provided in the region of the second and third insulating elements, for example in the form of washers, while the first insulating element serves substantially to keep the connection element centered and electrically insulated in the connection element receiving opening, but without transmitting significant forces, in particular forces acting in the circumferential direction, between the connection element and the connection element carrier.

The disclosure further relates to an exhaust system for an internal combustion engine, including an exhaust gas routing element having an outer wall and an exhaust gas flow space surrounded by the outer wall, an exhaust gas heater arranged in the exhaust gas flow space and at least one connection unit fixed to the outer wall and having a structure according to the disclosure, wherein the exhaust gas heater connection region of the at least one connection unit is electrically conductively connected to the exhaust gas heater.

BRIEF DESCRIPTION OF THE DRAWINGS

The invention will now be described with reference to the drawings wherein.

DESCRIPTION OF THE PREFERRED EMBODIMENTS

Figure 1:
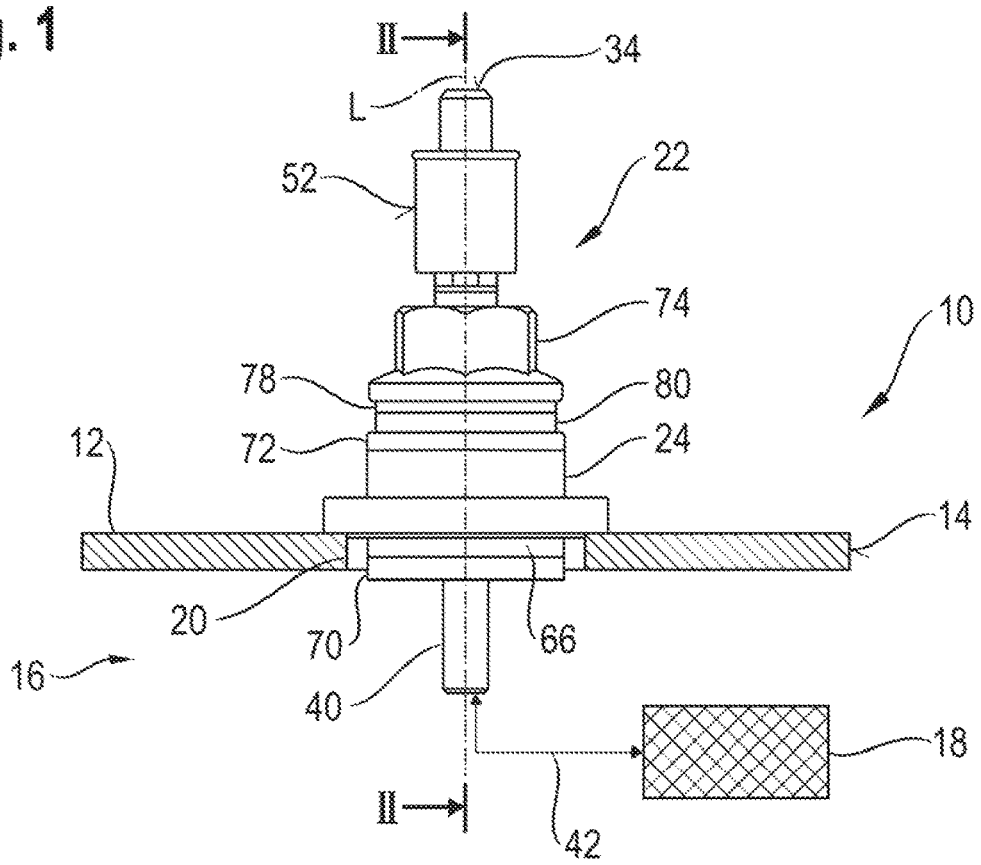
FIG. 1 shows a connection unit arranged on an outer wall of an exhaust gas routing element of an exhaust system.
Figure 2:
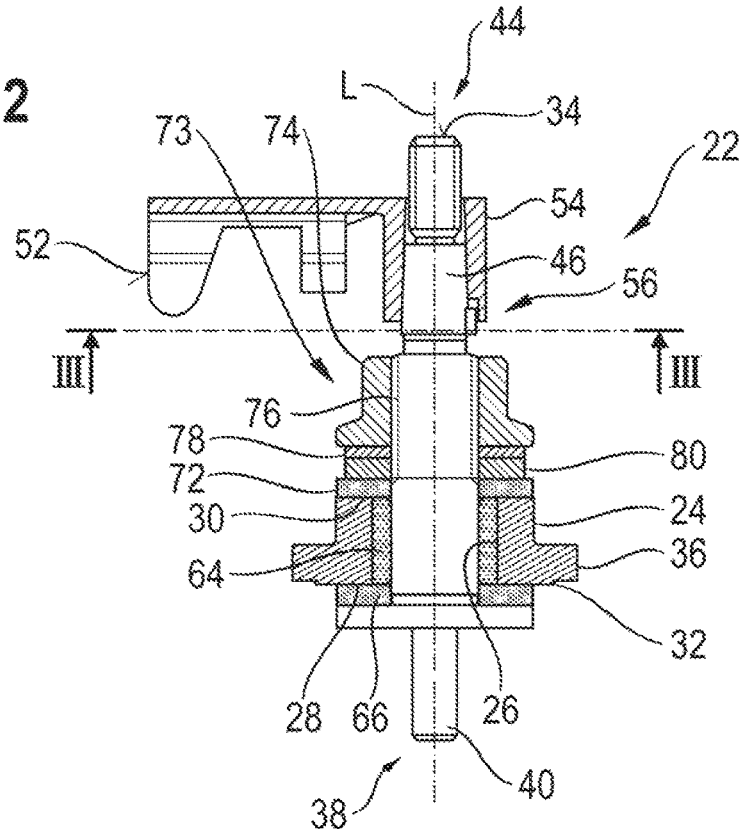
FIG. 2 shows the connection unit of FIG. 1 in longitudinal section, cut along a line II-II in FIG. 1.
Figure 3:
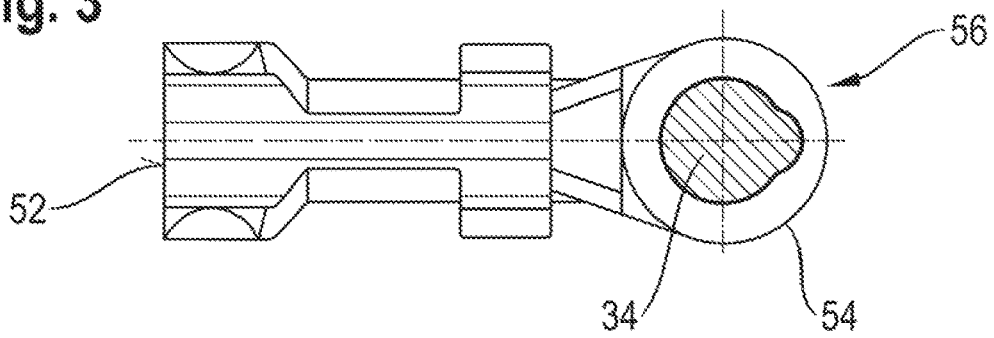
FIG. 3 shows the connection unit of FIG. 1 in cross-section, cut along a line III-III in FIG. 2.
Figure 4:
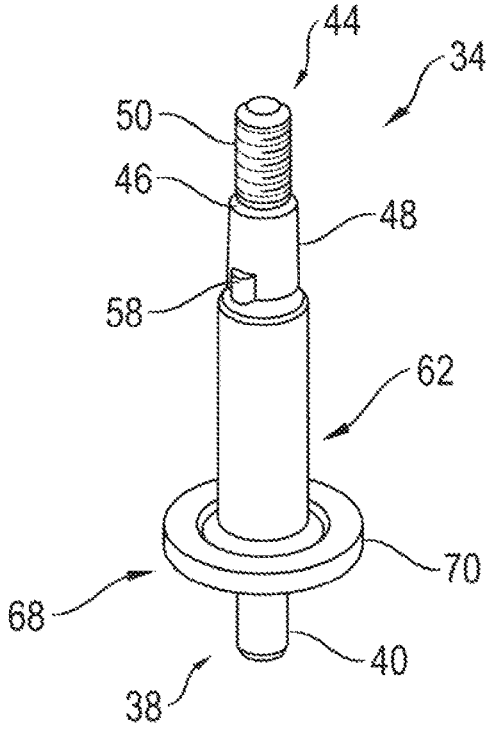
FIG. 4 is a perspective view of a connection element of the connection unit of FIG. 1.
Figure 5:
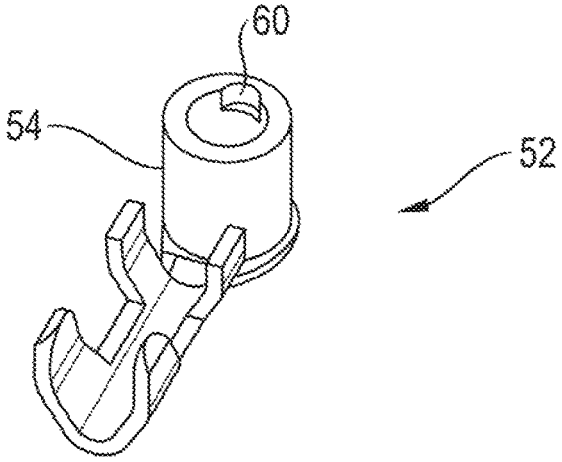
FIG. 5 is a perspective view of a supply line connection element of the connection unit of FIG. 1.
Figure 6:
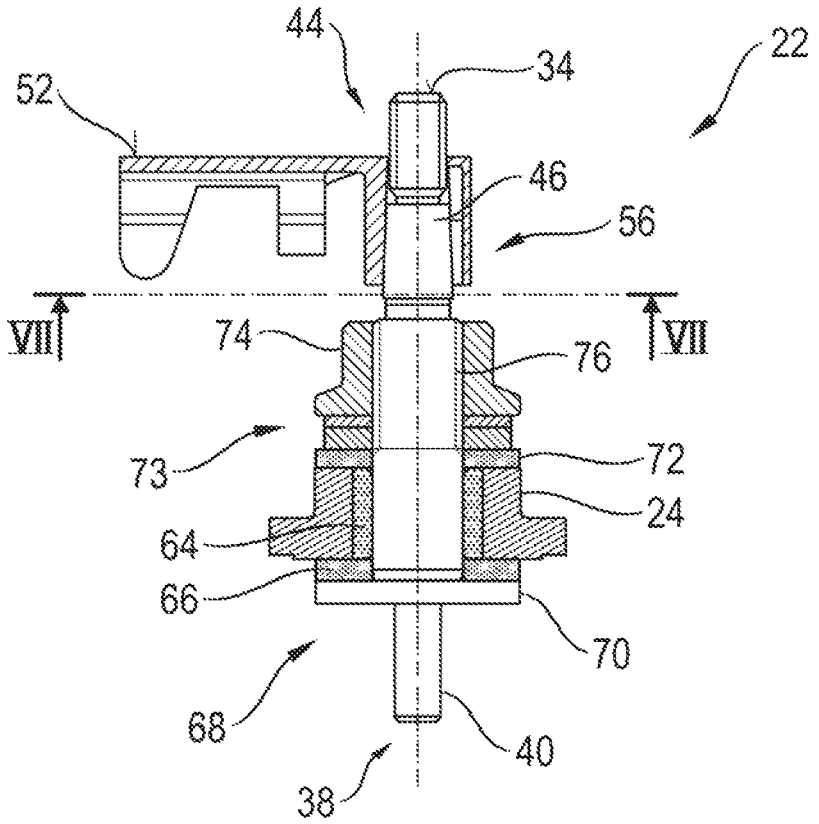
FIG. 6 is a longitudinal sectional view of a connection unit, corresponding to FIG. 2, with an alternative embodiment, in particular of a supply line connection element thereof.
Figure 7:
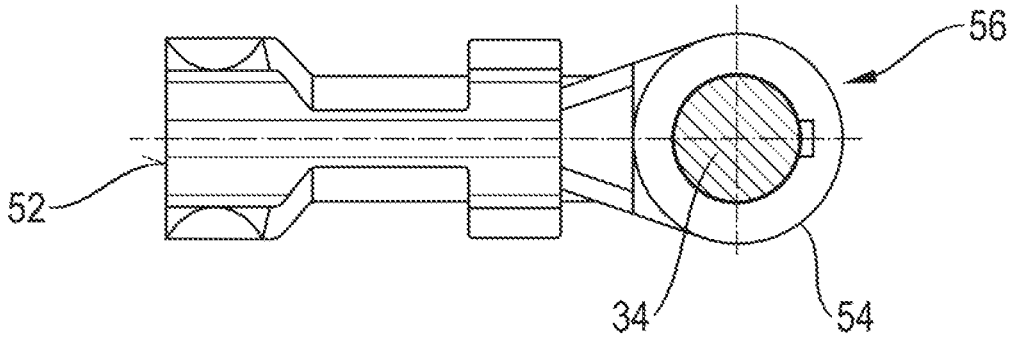
FIG. 7 is a cross-sectional view of the connection unit of FIG. 6, cut along a line VII-VII in FIG. 6.
Figure 8:
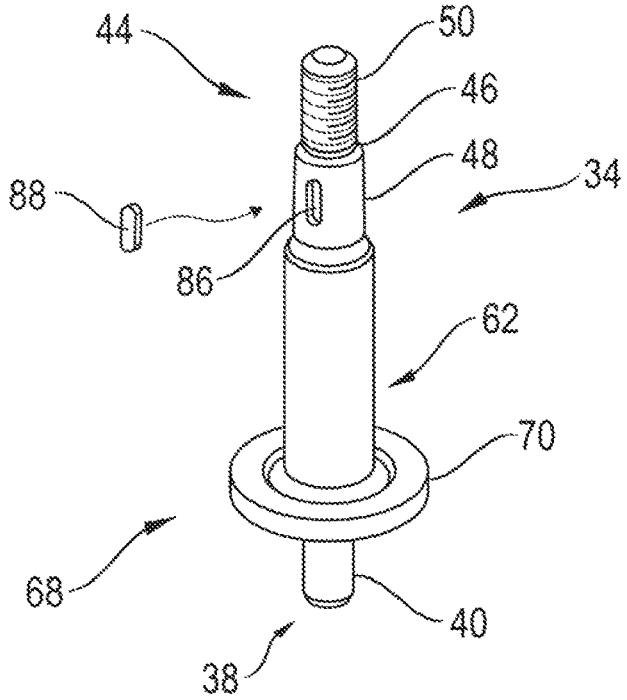
FIG. 8 is a perspective view of a connection element of the connection unit of FIG. 6.
Figure 9:
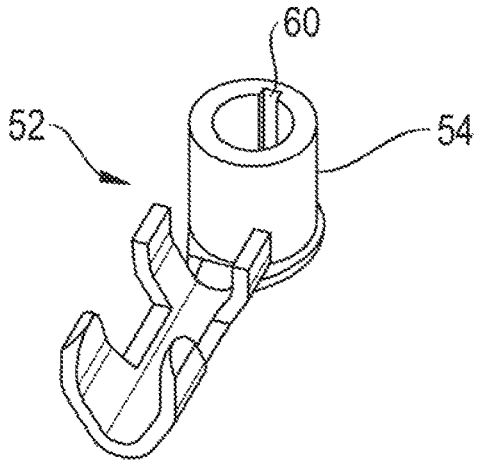
FIG. 9 is a perspective view of a supply line connection element of the connection unit of FIG. 6; and, FIG. 10 is a principle longitudinal sectional view of a connection element carrier with insulating elements provided thereon.

In FIG. 1, a detail of an exhaust system shown in principle for an internal combustion engine of a vehicle is denoted by reference numeral 10. An outer wall 12 of an exhaust gas routing element, which is generally denoted by reference numeral 14 and is, for example, tubular, delimits an exhaust gas flow space 16, in which the exhaust gas emitted by an internal combustion engine flows, for example, in the direction of an exhaust gas treatment unit, such as a catalytic converter arrangement or the like. An exhaust gas heater 18 is arranged in the exhaust gas flow space 16. This heater can include one or more heating conductors that can be heated by electrical excitation to transfer heat to the exhaust gas flowing around the conductor(s), which heat can be absorbed in an exhaust gas treatment unit following on downstream and can thus ensure accelerated heating of the exhaust gas.

In the region of an opening 20 provided in the outer wall 12, a connection unit generally denoted by reference numeral 22 is provided and fixed to the outer wall 12, for example by welding, to seal the exhaust gas flow space 16 in a gas-tight manner. The connection unit 22 provides an electrical feedthrough through the outer wall 12, via which a voltage source provided in a vehicle can be electrically conductively connected to the exhaust gas heater 18. In order to connect both poles of such a voltage source to the exhaust gas heater 18, for example, two such connection units 22 can be provided. If a plurality of exhaust gas heaters 18 are provided in the exhaust system 10, for example at different axial positions, two such connection units 22 can be provided in association with each exhaust gas heater 18.

The connection unit 22 shown in more detail in FIGS. 2 to 5 includes a sleeve-like or bush-like connection element carrier 24 constructed with metal material. The connection element carrier 24 has a connection element receiving opening 26 which extends between a first axial end face 28 and a second axial end face 30 of the connection element carrier 24. In the state shown in FIG. 1, in which the connection unit 22 is fixed to the outer wall 12, the first end face 28 is positioned facing the exhaust gas flow space 16 or the exhaust gas routing element 14.

In order to ensure a defined positioning of the connection unit 22 in the opening 20 of the outer wall 12, a centering protrusion 32 can be formed on the first end face 28, the centering protrusion being able to be radially dimensioned in such a way that it can be positioned engagingly in the opening 20 with little radial movement play, radially with respect to a longitudinal axis L of an electrically conductive connection element 34 or of the entire connection unit 22.

With a flange-like edge region 36 projecting radially outward beyond the centering protrusion 32, the connection element carrier 24 rests against the outer side of the outer wall 12 and can be firmly connected to the latter in a gas-tight manner, for example by an external circumferential weld seam.

The connection element 34 passing through the connection element receiving opening 26 in the connection element carrier 24 has an exhaust gas heater connection region 40 in a first axial end region 38 to be positioned engagingly in the exhaust gas flow space 16, in which exhaust gas heater connection region a connection line 42 shown schematically in FIG. 1 and establishing an electrical connection to the exhaust gas heater 18 can be electrically conductively connected to the connection element 34, for example by materially bonded connection, such as soldering or welding. In an alternative embodiment, the exhaust gas heater connection region 40 can also be positioned engagingly in the exhaust gas flow space 16 in such a way that it rests against a contact region of the exhaust gas heater 18 under prestress and thus realizes the electrical contact.

A supply line connection region 46 is formed at a second axial end region 44 of the connection element 34. This supply line connection region has a contact region 48 tapering, for example conically, in the direction away from the first end region 38 and an axially adjoining external threaded region 50. A supply line connection element 52 with a sleeve-like mating contact region 54 is pushed onto the contact region 48. Once this is achieved, a nut element (not shown) is screwed onto the external threaded region 50 in order to prestress the supply line connection element 52 against the contact region 48 and hold it firmly against the connection element 34.

In order to specify a defined connection position for a supply line in a vehicle, the supply line being intended to be firmly connected to the supply line connection element 52, for example by clamping, a form-fit positioning formation 56 is provided, which includes a form-fit protrusion 58 protruding radially outward at a circumferential position on the connection element 34, in particular the contact region 48 thereof, and an axially open form-fit recess 60 on the sleeve-like mating contact region 54 of the supply line connection element 52. When the supply line connection element 52 is pushed axially onto the supply line connection region 46 of the connection element 34, the form-fit recess 60 and the form-fit protrusion 58 are positioned in circumferential alignment with each other so that the form-fit protrusion 58 can enter the form-fit recess 60 when the supply line connection element 52 is pushed axially onto the contact region 48. In this way, a defined circumferential positioning for the supply line connection element 52 with respect to the connection element 34 about its longitudinal axis L is predetermined.

In order to keep the connection element 34 in a defined position electrically insulated with respect to the connection element carrier 24, a support region 62 of the connection element 34, the support region being positioned between the two axial end regions 38, 44 of the connection element 34 and passing through the connection element receiving opening 26, is surrounded by a sleeve-like first insulating element 64. The first insulating element 64, constructed with electrically insulating material, for example sintered ceramic material or the like, surrounds the support region 62 substantially without play, but also without substantial frictional interaction. The first insulating element 64 is positioned in the connection element receiving opening 26 and rests against an inner circumferential surface of the connection element carrier 24 surrounding the connection element receiving opening 26 without generating substantial frictional forces. The first insulating element 64 thus electrically insulates the connection element 34 in the region of its support region 62 passing through the connection element receiving opening 26 and supports the connection element in a centered manner in the connection element receiving opening 26, without any significant torques being able to be transmitted between the connection element 34 and the connection element carrier 24.

A washer-like or annular washer-like second insulating element 66 made of electrically insulating material, for example sintered ceramic material or the like, is arranged on the first end face 28 of the connection element carrier 24 to be positioned facing the exhaust gas flow space 16. The second insulating element 66 is axially supported in the region of the centering protrusion 32 on the connection element carrier 24.

In association with the second insulating element 66, a first abutment arrangement generally denoted by reference numeral 68 is provided for axial support of the connection element 34. This includes a flange-like abutment protrusion 70 provided on the connection element 34, for example as an integral part thereof, protruding radially outward and preferably running around substantially completely in the circumferential direction. Via the abutment protrusion 70, the connection element 34 is supported via the second insulating element 66 on the connection element carrier 24 in a first axial direction, in particular in a direction away from the exhaust gas flow space 16.

A washer-like or annular washer-like third insulating element 72 made of electrically insulating material, for example sintered ceramic material or the like, is provided for axial support with respect to the second end face 30. A second abutment arrangement, generally denoted by reference numeral 73, is provided for axial support of the connection element 34 in a second axial direction, opposite the first axial direction, towards the exhaust gas flow space 16. The second abutment arrangement 73 includes a nut element which has an internal thread and which is constructed, for example, of metal material and acts as an abutment element 74 and is screwed onto an external thread 76 provided in the region of the support region 62 of the connection element 34, so that, by rotating the nut element with respect to the connection element 34, the nut element is displaced axially with respect to the connection element 34.

Axially arranged between the abutment element 74 of the second abutment arrangement 73 and the second insulating element 66 are an axially elastic support element 78, for example in the form of a disc spring or corrugated spring, and an intermediate washer 80, for example made of metal material. The intermediate washer 80 ensures that the second insulating element 66 is uniformly loaded with the axial load generated or transmitted by the axially elastic support element 78, even if the axially elastic support element, when embodied as a disc spring or corrugated spring, is only supported on the intermediate washer 80 in limited radial regions or circumferential regions.

The interaction of the two abutment arrangements 68, 73 ensures a defined axial clamping of the connection element 34 with interpositioning of the sandwich-like insulation formed with the three insulating elements 64, 66 and 72. By providing the axially elastic support element 78 in the axial support path or force transmission path between the connection element 34 and the connection element carrier 24, different thermal expansions of the components of the connection unit 22, which are also subjected to different thermal loads and possibly made of different materials, are permitted without generating local stresses or overloads. The axial clamping force can be adjusted by screwing the abutment element 74 onto the external thread 76 in a defined manner. A defined rotational positioning of the connection element 34 with respect to the connection element carrier 24 is achieved here by the components frictionally bearing against one another between the various axially consecutive components. In order to be able to further define the rotational positioning of the connection element 34 with respect to the connection element carrier 24, a form-fit positioning formation cooperating with the second insulating element 66 could, for example, be provided on the first end face 28 of the connection element carrier 24, which form-fit positioning formation defines the rotational position of the second insulating element 66 with respect to the connection element carrier 24, for example via one or more form-fit protrusions axially engaging in associated form-fit recesses. Accordingly, a form-fit positioning formation could act between the second insulating element 66 and the abutment protrusion 70 of the connection element 34, in order to define the rotational positioning of the connection element 34 with respect to the second insulating element 66 and, via the second insulating element, with respect to the connection element carrier 24.

Figure 10:
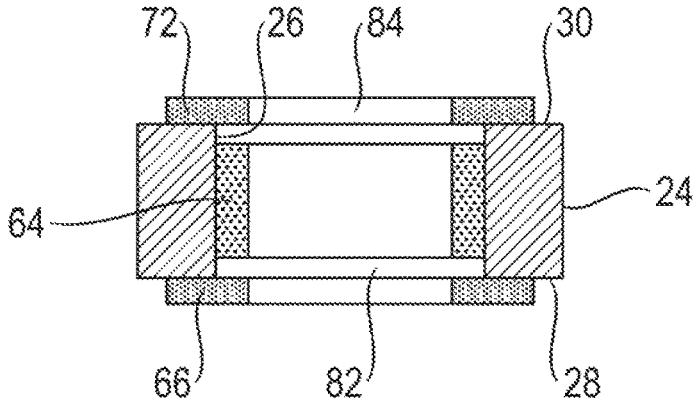

In order to avoid the occurrence of constraint stresses or local overloads, in particular in the case of thermally induced dimensional changes, the sleeve-like first insulating element 64 is dimensioned, as shown in principle in FIG. 10, in such a way that its axial extension is no greater, and preferably less, than the axial extension of the connection element receiving opening 26 receiving the first insulating element or than the axial distance between the two end faces 28, 30 of the receiving element carrier 24, in particular in those regions in which the washer-like insulating elements 66, 72 are supported on these end faces, or than the axial distance between the two washer-like insulating elements 66, 72. For example, the first insulating element 64 can be dimensioned and positioned in the connection element receiving opening 26 in such a way that, between the first insulating element and each of the two washer-like insulating elements 66, 72, a gap-like axial space 82, 84 is formed with an axial extent in the range from one or a few tenths of a millimeter to one or more millimeters. Thus, axial forces can be exerted on the end faces 28, 30 of the connection element carrier 24 by the two abutment arrangements 68, 73 via the washer-like insulating elements 66, 72 without loading the sleeve-like first insulating element 64. As already explained above, the first insulating element can thus fundamentally fulfil its functions of providing radial centering and electrical insulation of the connection element 34 with respect to the connection element carrier 24 without transmitting substantial forces therebetween, in particular substantial forces acting in the circumferential direction and in the radial direction.

For example, the first insulating element 64 could also be positioned in the connection element receiving opening 26 such that it is in abutting contact with the radially inner region of one of the two washer-like insulating elements 66, 72, but has the axial gap or a larger axial gap to the other of the two washer-like insulating elements 66, 72 than shown in FIG. 10. Although in such an embodiment, with axial gaps 82, 84 formed on one or both axial sides of the first insulating element 64, the connection element 34 is not covered by the electrical insulation including the three insulating elements 64, 66, 72 over the entire axial range of extent of the insulation; efficient electrical insulation between the connection element 34 and the connection element carrier 24 is nevertheless ensured.

A modified embodiment of the connection unit 22 is shown in FIGS. 6 to 9. In this type of embodiment, the structure of the connection unit 22 corresponds to the structure described above with reference to FIGS. 1 to 5, in particular with regard to the embodiment of the connection element carrier 24 and the support or electrical insulation of the connection element 34 with respect thereto via the electrical insulation including the three insulating elements 64, 66 and 72 as well as the abutment arrangements 68, 73, and therefore reference can be made to the comments provided in this regard.

However, there is a structural difference in the embodiment of the form-fit positioning formation 56 acting between the connection element 34 and the supply line connection element 52. In the configuration shown in FIGS. 6 to 9, this formation includes the form-fit recess 60 provided on the sleeve-like mating contact region 54, which is axially open and, in this embodiment, axially further extended, and also includes a form-fit recess 86 on the contact region 48, which is elongated, for example, in the direction of the longitudinal axis L of the connection element 34. The form-fit interaction between the two form-fit recesses 60, 86 is produced by a form-fit element 88, for example of pin-like or ball-like configuration, which is inserted into the form-fit recess 86 before the supply line connection element 52 is pushed axially onto the supply line connection region 46 of the connection element 34, and projects radially outward beyond the latter. The supply line connection element 52 is then pushed onto the second axial end region 44 or the supply line connection region 46 in such a way that the form-fit element 88 projecting radially outward over the contact region 48 enters the form-fit recess 60 and thus provides a defined positioning of the supply line connection element 52 with respect to the connection element 34 in the circumferential direction about the longitudinal axis L.

The configuration of a connection unit according to the disclosure provides a structurally simple, easy to manufacture and mechanically stable embodiment, which avoids the existence of local overload regions due to various thermal expansions, even under high thermal load. The possibility of being able to specify defined rotational positioning between the connection element and the supply line connection elements or the connection element carrier means that a defined installation position can be achieved, via which a defined adaptation to the course of a cable harness in a vehicle or supply lines provided therein is achieved, which avoids unnecessary bending or deformation in the region of a supply line to be connected to such a connection unit. Since the force with which the connection element is held prestressed with respect to the connection element carrier, in particular held prestressed in the axial direction, is freely adjustable, it is possible to achieve adaptations to various geometric tolerances and, due to the intended manner of force transmission, also to avoid excessive loading on the insulating elements constructed with electrically insulating material and realizing the axial support.

Lastly, it should be noted that although the above-described application is particularly advantageous in conjunction with an exhaust system and an exhaust gas heater to be supplied with a supply voltage, such a connection unit can of course also be used in other fields of application in which electrical contact between two system regions is to be provided through a wall.

It is understood that the foregoing description is that of the preferred embodiments of the invention and that various changes and modifications may be made thereto without departing from the spirit and scope of the invention as defined in the appended claims.

What is claimed is:

1. A connection unit for connecting an electrical supply line to an exhaust gas heater of an exhaust system of an internal combustion engine, the connection unit comprising:

a connection element defining a longitudinal axis (L) and being elongated along said longitudinal axis (L);

said connection element being electrically conductive and having first and second axial end regions;

said connection element having an exhaust gas heating connection region in said first axial end region and having a connection region for said electrical supply line in said second axial end region;

a connection element carrier having a first end face and a second end face, said first end face facing toward said first axial end region of said connection element and facing away from said second axial end face, said second end face facing toward said second axial end region of said connection element and facing away from said first axial end face, said connection element carrier defining a connection element receiving opening extending between said first end face and said second end face for accommodating said connection element therein;

said connection element having a support region lying between said first and second axial end regions;

a first insulating element arranged in said connection element receiving opening, said first insulating element being configured as an insulating sleeve surrounding said support region;

a second insulating element arranged on said first end face;

said connection element being supported axially with respect to said first end face of said connection element carrier via said second insulating element;

a third insulating element arranged on said second end face of said connection element carrier;

said connection element being supported axially with respect to said second end face of said connection element carrier via said third insulating element;

said first insulating element, said second insulating element and said third insulating element being configured as separate components; and, an axial gap being formed between said first insulating element and at least one insulating element of said second insulating element and said third insulating element.

2. The connection unit of claim 1, wherein at least one of the following applies:

i) said second insulating element is configured as an insulating washer; and, ii) said third insulating element is configured as an insulating washer.

3. The connection unit of claim 1, wherein at least one of the following applies:

i) an axial extension of said first insulating element is less than an axial distance of said second insulating element to said third insulating element; and, ii) an axial extension length of said first insulating element is less than an axial extension length of said connection element receiving opening.

4. The connection unit of claim 1, further comprising first and second abutment arrangements; and, said connection element being axially supported on said second insulating element via said first abutment arrangement and being axially supported on said third insulating element via said second abutment arrangement.

5. The connection unit of claim 4, wherein at least one of the following applies:

i) one abutment arrangement of said first abutment arrangement and said second abutment arrangement includes an abutment protrusion fixedly provided on said connection element so as to project radially outwardly; and, ii) one abutment arrangement of said first and second abutment arrangements includes an abutment element coupled to said connection element in an axially displaceable manner with respect thereto.

6. The connection unit of claim 5, wherein said abutment element is threadably coupled to said connection element.

7. The connection unit of claim 4, wherein at least one abutment arrangement of said first abutment arrangement and said second abutment arrangement includes at least one axially elastic support element in a support path between said connection element and said connection element carrier.

8. The connection unit of claim 7, wherein said at least one axially elastic support element is configured as a disc spring or corrugated spring.

9. The connection unit of claim 1, further comprising a centering protrusion surrounding said connection element receiving opening on said first axial end face of said connection element carrier.

10. The connection unit of claim 9, wherein said second insulating element is axially supported on said centering protrusion.

11. The connection unit of claim 1, further comprising a supply line connection element coupled or couplable to said connection element in said supply line connection region.

12. The connection unit of claim 11, further comprising a form-fit positioning formation for holding said supply line connection element in a predetermined position about said longitudinal axis (L) with respect to said supply line connection region.

13. The connection unit of claim 1, wherein said connection element is held in a rotationally fixed manner with respect to said connection element carrier via at least one of a friction fit and a form fit.

14. An exhaust system for an internal combustion engine, the exhaust system comprising:

an exhaust gas routing element having an outer wall defining an exhaust gas flow space;

an exhaust gas heater arranged in said exhaust gas flow space;

at least one connection unit fixed to said outer wall;

said connection unit including:

a connection element defining a longitudinal axis (L) and being elongated along said longitudinal axis (L);

said connection element being electrically conductive and having first and second axial end regions;

said connection element having an exhaust gas heating connection region in said first axial end region and having a connection region for said electrical supply line in said second axial end region;

a connection element carrier having a first end face and a second end face, said first end face facing toward said first axial end region of said connection element and facing away from said second axial end face, said second end face facing toward said second axial end region of said connection element and facing away from said first axial end face, said connection element carrier defining a connection element receiving opening extending between said first end face and said second end face for accommodating said connection element therein;

said connection element having a support region lying between said first and second axial end regions;

a first insulating element arranged in said connection element receiving opening, said first insulating element being configured as an insulating sleeve surrounding said support region;

a second insulating element arranged on said first end face;

said connection element being supported axially with respect to said first end face of said connection element carrier via said second insulating element;

a third insulating element arranged on said second end face of said connection element carrier;

said connection element being supported axially with respect to said second end face of said connection element carrier via said third insulating element;

said first insulating element, said second insulating element and said third insulating element being configured as separate components;

an axial gap being formed between said first insulating element and at least one insulating element of said second insulating element and said third insulating element; and, said exhaust gas heater connection region of said at least one connection unit being electrically conductively connected to said exhaust gas heater.

* * * * *